United States Patent [19]

Van Soest et al.

[11] 4,376,487

[45] Mar. 15, 1983

[54] ANTI-SWAY, ANTI-ROTATION MECHANISM FOR CRANE REEVING

[75] Inventors: Cornelius J. M. Van Soest; Rostislav Muller; Stjepan Bagaric, all of Port Moody, Canada

[73] Assignee: Harnischfeger Corp. of Canada Ltd., Canada

[21] Appl. No.: 227,450

[22] Filed: Jan. 22, 1981

[51] Int. Cl.[3] ..... B66C 13/06

[52] U.S. Cl. ..... 212/147; 212/146; 212/221

[58] Field of Search ..... 212/146–148, 212/220, 221, 84, 127; 414/735

[56] References Cited

U.S. PATENT DOCUMENTS 3,877,743 4/1975 Johnson ..... 414/735

OTHER PUBLICATIONS

*New Zealand Engineering,* vol. 30, No. 3, pp. 73–78, Mar. 15, 1975.

*Primary Examiner*—Robert G. Sheridan

*Attorney, Agent, or Firm*—Townsend and Townsend

[57] ABSTRACT

An anti-sway, anti-rotation mechanism for crane reeving comprises four spaced-apart overhead sheaves on an overhead support. A lifting beam assembly has four pairs of lifting beam sheaves. The pairs of lifting beam sheaves are spaced-apart from each other. A grapple is pivotally connected to the lifting beam assembly. Cables are connected to the winding drum and extend between each pair of lifting beam sheaves and two adjacent overhead sheaves in a V-shaped arrangement to keep the lifting beam assembly level and prevent the lifting beam assembly from swaying and rotating, during operation of the crane.

6 Claims, 5 Drawing Figures

ANTI-SWAY, ANTI-ROTATION MECHANISM FOR CRANE REEVING

FIELD OF THE INVENTION

This invention relates to an anti-sway, anti-rotation mechanism for crane reeving.

DESCRIPTION OF THE PRIOR ART

With many loading cranes, for example log handling portal cranes, it is desirable to lift unbalanced loads with a grapple or to lift logs, or other items, from the side of a pile. However, if this is attempted with the standard arrangement of cables and grapple, several problems arise. An unbalanced load may cause the cables to deviate from the vertical, possibly allowing the logs or other material to contact the crane and cause damage. Additionally, attempting to retrieve logs from the side of a pile with a standard crane may result in dangerous swinging of the load and entangling of the cables as the load is lifted. Accordingly, it would be desirable to provide a mechanism which would permit a crane to lift an unbalanced load, thus making handling faster, while maintaining the crane cables vertical. Similarly, it would be desirable to provide a crane where the logs or other items could be retrieved from the side of a pile while the cables remain vertical.

In the past, the arrangement of four cables extending downwardly from a winding drum and passing through four spaced-apart sheaves on a load carrying frame has been employed for container handling cranes as seen, for example, in Canadian Pat. No. 679,557 to Ramsen. However, this arrangement has been used only to keep the load level and this patent does not disclose a combination which prevents swaying and rotation, permits the crane to lift an unbalanced load of logs, or the like, or which permits the crane to retrieve logs from the side of a storage pile.

SUMMARY OF THE INVENTION

The invention provides an anti-sway, anti-rotation mechanism for reeving of a crane having an overhead support with a winding drum. The mechanism comprises four overhead sheaves on the overhead support, the winding drum being between two pairs of the overhead sheaves. A lifting beam assembly has four pairs of lifting beam sheaves, the pairs of sheaves being spaced-apart from each other. Load carrying means is connected to the lifting beam assembly. Cables are connected to the winding drum and extend about each said pair of the lifting beam sheaves and two adjacent said overhead sheaves in an upwardly opening V-shaped arrangement to prevent swaying and rotation of the lifting beam assembly during operation of the crane and keep the lifting beam assembly level.

The invention permits the load carrying means, or grapple, to hang at an angle with the vertical, as would occur when the grapple is carrying an unbalanced load or retrieving logs from the side of a pile, while maintaining the alignment of the cables with the vertical. Consequently, no dangerous swinging of the load occurs and there is no additional risk of the load contacting the crane structure. The speed of handling is accordingly increased, since there is no need to balance loads for safe handling, and the grapple can easily retrieve logs, or other material, from a sloping pile.

BRIEF DESCRIPTION OF THE DRAWINGS

In drawings which illustrate embodiments of the invention:

FIG. 4 is a perspective view showing the lifting beam assembly and the grapple carrying an unbalanced load of logs.

DESCRIPTION OF THE PREFERRED EMBODIMENTS

Figure 1:
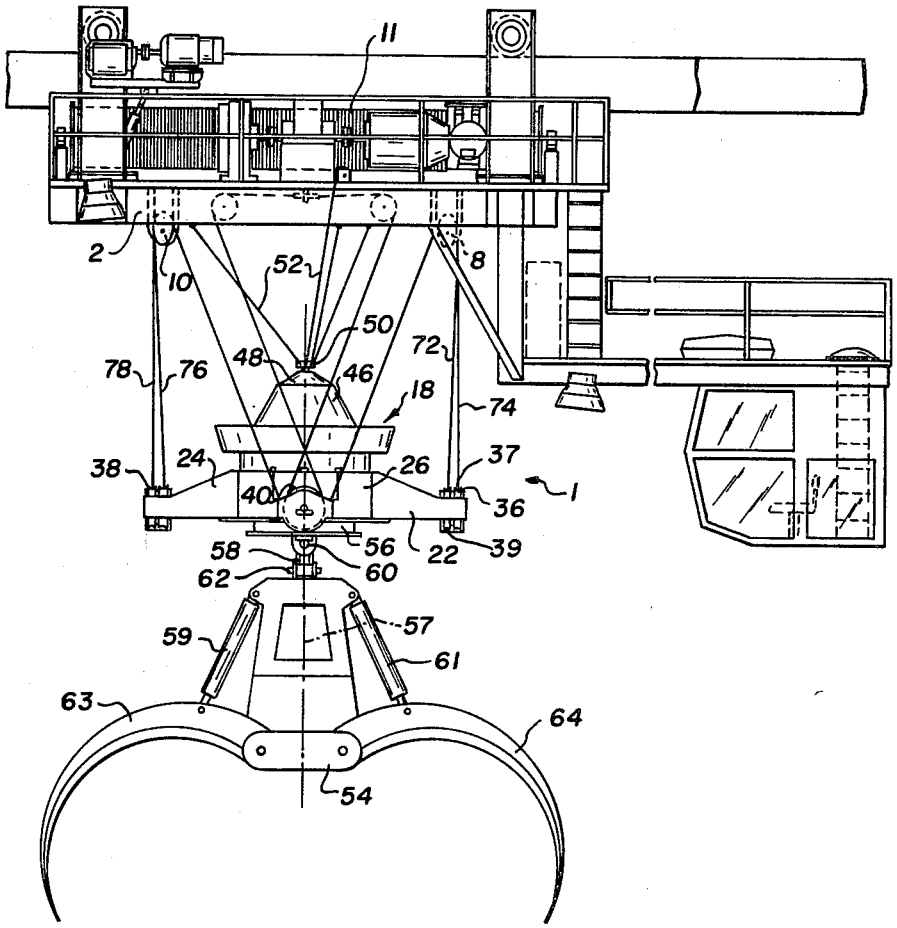
FIG. 1 is a side elevational view showing an anti-sway, anti-rotation mechanism, according to an embodiment of the invention, associated with the trolley of a portal crane.

The drawings illustrate an anti-sway, anti-rotation mechanism 1 for cranes. The mechanism 1 is associated with an overhead support, in this case the trolley 2 of an overhead crane. The mechanism is suitable for portal-type or rotating-type log handling cranes as well as other types of overhead cranes. The mechanism includes four spaced-apart overhead sheaves 4, 6, 8 and 10, each rotatably connected to the trolley 2. The winding drum 11 is between the pair of overhead sheaves 4 and 6 and the pair of sheaves 8 and 10.

The mechanism 1 includes a lifting beam assembly 18 which is cruciform in shape, having four arms 22, 24, 26 and 28, extending at right angles to each other. The lifting beam assembly 18 has four pairs of lifting beam sheaves 36, 38, 40 and 42, which are spaced-apart from each other. Each pair comprises a pair of coaxial and adjacent lifting beam sheaves rotatably connected to the arms, for example, outer sheave 37 and inner sheave 39 of pair 36.

A cable basket 46 is connected to the top of lifting beam assembly 18 and its top 48 is adapted to contact the limit switch assembly 50, suspended by cables 52, when the lifting beam reaches it upper limit.

A load carrying means or grapple 54 is rotatably connected to the bottom 56 of lifting beam assembly 18, for rotation about vertical axis 57, by means of the double articulated joint 58. Joint 58 has a pair of link pins 60 and 62 at right angles to each other to permit pivoting of grapple 54 about two perpendicular, horizontal axes. Grapple 54 is a standard type of grapple employing a pair of cylinders 59 and 61 to open and close a pair of load carrying arms 63 and 64.

The lifting beam assembly 18 is suspended below the trolley 2 by means of four cable assemblies including a first pair of cables 72 and 74 and a second pair of cables 76 and 78. Cable 72 extends downwardly from drum 11 towards lifting beam assembly 18 and extends about the inner sheave of the pair of sheaves 36. From here, cable 72 extends upwardly and about overhead sheave 8. From sheave 8, cable 72 extends downwardly and about the inner sheave of the pair of sheaves 40 which is adjacent pair 36. Cable 72 then extends upwardly to its end 80 which is connected to trolley 2.

Figure 5:
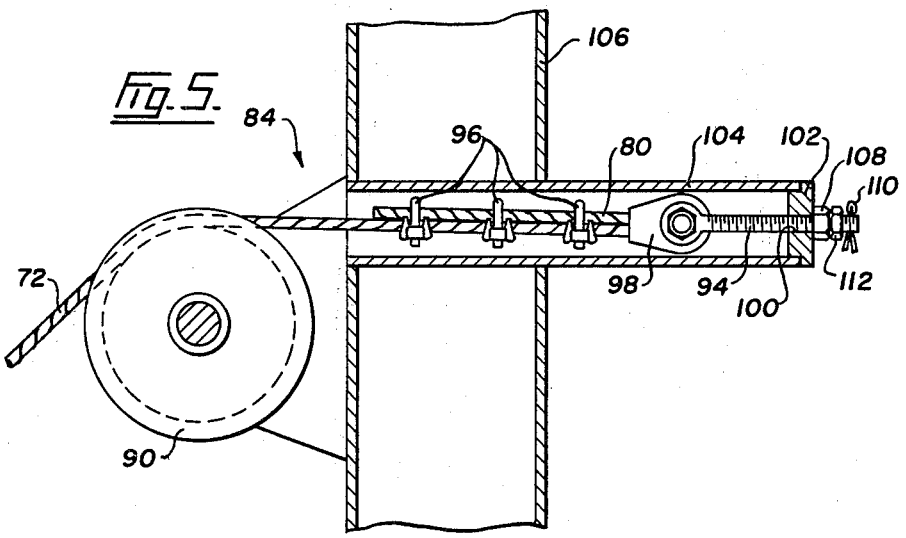
FIG. 5 is a side elevational view, partly in section, of a device for adjusting the lengths of cables of the mechanism.

There is an adjusting means or mechanism 84 near the end 80 of cable 72 for adjusting its length and similar mechanisms for each of the other cables. As seen in FIG. 5, there is a tensioning pulley 90 connected to the trolley 2. Cable 72 extends over sheave 90 and is connected to an eye bolt 94 at its end 80 by means of three rope clips 96 and a thimble 98. Bolt 94 extends through aperture 100 in retainer 102 at the end of a sleeve 104 which is connected to the frame 106 of the trolley 2. A nut 108 is threadedly received on the end of bolt 94, while cotter pin 110 and lock nut 112 keep nut 108 in place. Bolt 94 and nut 108 provide a threaded connector connected to the cable 72, whereby the length of the cable can be adjusted by tightening or loosening nut 108.

Cable 74 extends downwardly from the drum 11 and about the other sheave of the pair of sheaves 36. From here, cable 74 extends upwardly and about overhead sheave 4, which is adjacent sheave 8 of cable 72, and downwardly to the outer sheave of the pair of sheaves 42. From here, cable 74 extends upwardly to its end 114 which is connected to the trolley by means of one of the adjusting mechanisms 84.

While cables 72 and 74 both extend downwardly from drum 64 to the pair of lifting beam sheaves 36, they then extend to different, but adjacent, overhead sheaves 4 and 8. They then extend downwardly to opposite pairs of lifting beam sheaves 40 and 42.

The cables 76 and 78 extend downwardly and about the inner sheave and outer sheave, respectively, of the pair of lifting beam sheaves 38. From pair 38, cable 76 extends upwardly, about overhead sheave 10, downwardly about the outer sheave of the pair of lifting beam sheaves 40 and then upwardly to its end 116, which is connected to trolley 2 by means of one of the adjusting mechanisms 84.

From the pair of sheaves 38, cable 78 extends upwardly and then about overhead sheave 6. From here, cable 78 extends downwardly and about the inner sheave of the pair of lifting beam sheaves 42. From here, cable 78 extends upwardly to its end 118 which is connected to the trolley 2 by means of one of the adjusting mechanisms 84.

In use, the simultaneous winding or unwinding of cables 72, 74, 76 and 78 by drum 11 permits the raising or lowering of lifting beam assembly 18 while maintaining its level attitude. In this respect, only, is the invention similar to the arrangement found in the container handling crane of Canadian Patent 679,557. In the preferred form of the invention, it should be noted that lifting beam assembly 18 is suspended from above the pair of lifting beam sheaves 40 at two-spaced apart points, namely adjacent overhead sheaves 8 and 10, by portions of cables 72 and 76. A similar V-shaped arrangement of cables is found at each of the other pairs of lifting beam sheaves 36, 38, and 42. This V-shaped arrangement prevents swaying of the lifting beam assembly 18 either along the axis of drum 11 or in the perpendicular direction.

Figure 3:
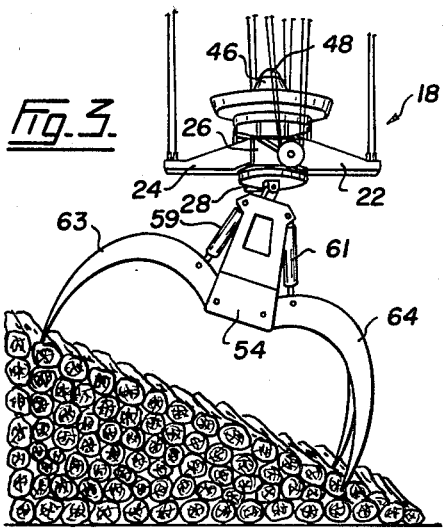
FIG. 3 is a perspective view showing the lifting beam assembly of the mechanism and the grapple loading from a sloping pile of logs.
Figure 4:
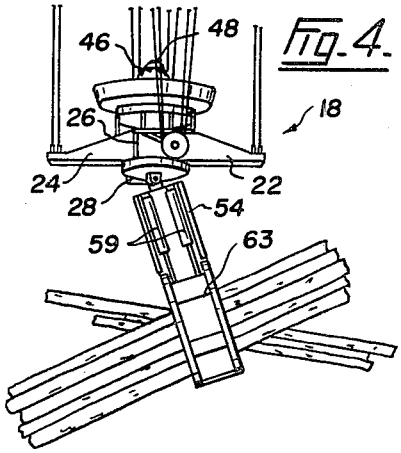
FIG. 4, is a reeving diagram for the mechanism.
Figure 2:
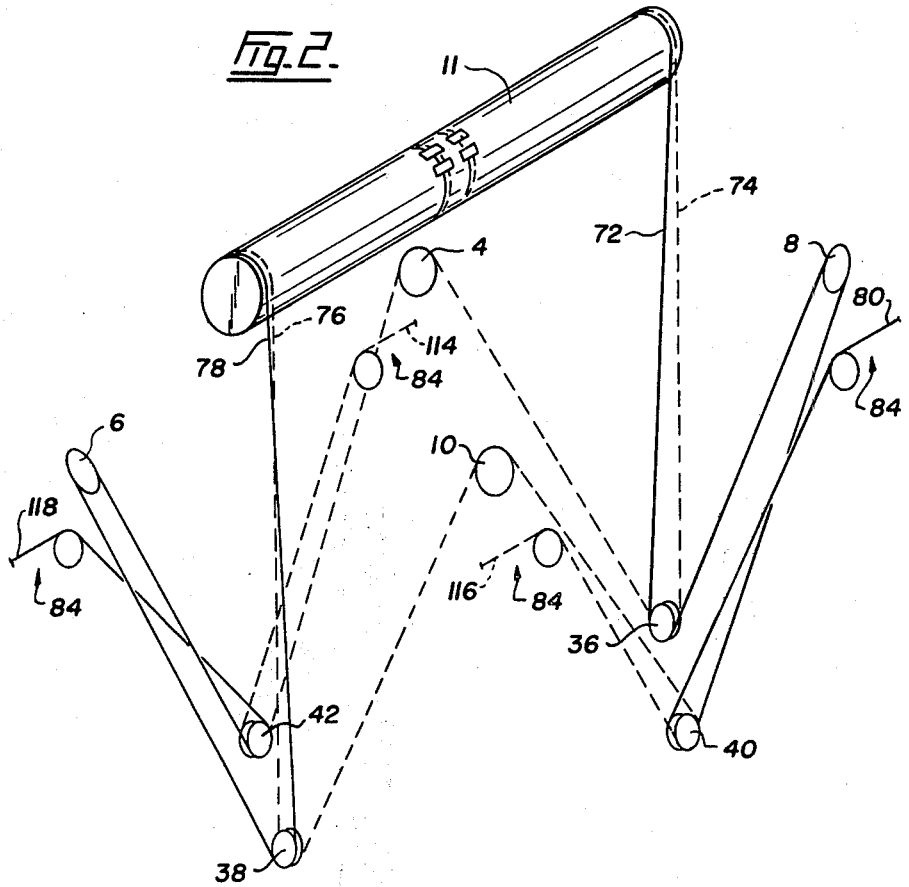
FIG. 2, appearing after

Referring to FIG. 3, it may be seen how the double articulated connection 58 permits the grapple 54 to rotate and pivot to pick up logs from the side of a pile while the lifting beam assembly 18 remains horizontal. Similarly, FIG. 4 illustrates how the grapple can be held at an angle to hold an unbalanced load of logs, while the lifting beam assembly 18 again remains level.

We claim:

1. An anti-sway, anti-rotation mechanism for reeving of a crane having an overhead support with a winding drum, the mechanism comprising:

four spaced-apart overhead sheaves on the overhead support, the winding drum being between two pairs of the overhead sheaves;

a lifting beam assembly with four pairs of lifting beam sheaves, the pairs of sheaves being spaced-apart from each other;

load carrying means connected to the lifting beam assembly; and four cables comprising two pairs of adjacent cables extending downwardly from the winding drum, each cable extending downwardly and about one said lifting beam sheave of one said pair of lifting beam sheaves, then upwardly and about an overhead sheave, then downwardly and about another said lifting beam sheave of another pair of lifting beam sheaves adjacent said one pair of sheaves, then upwardly to an end of the cable adjacent the overhead support to prevent swaying and rotation of the lifting beam assembly during operation of the crane and to keep the lifting beam assembly level.

2. A mechanism as claimed in claim 1, each said pair of the lifting beam sheaves being on an arm of a cross.

3. A mechanism as claimed in claim 2, the cables of each said pair of cables extending downwardly to different said lifting beam sheaves on one said arm of the cross, then upwardly to adjacent said overhead sheaves and then downwardly to lifting beam sheaves on opposite arms of the cross.

4. A mechanism as claimed in claim 3 comprising means for adjusting the lengths of the cables.

5. A mechanism as claimed in claim 4, the means for adjusting comprising four tensioning sheaves rotatably connected to the overhead support, the cables each extending over one said tensioning sheave near said end of each cable, and a threaded connector connecting said end of each said cable to the overhead support.

6. A mechanism as claimed in claim 1 or claim 5, the lifting beam assembly having a bottom, the load carrying means being pivotally connected to the bottom of the lifting beam assembly.

* * * * *